US007981374B2

(12) United States Patent
Strack et al.

(10) Patent No.: US 7,981,374 B2
(45) **Date of Patent: *Jul. 19, 2011**

(54) METHOD FOR PROCESSING HYDROCARBON PYROLYSIS EFFLUENT

(75) Inventors: Robert David Strack, Houston, TX (US); John R. Messinger, Kingwood, TX (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 267 days.

This patent is subject to a terminal disclaimer.

(21) Appl. No.: 12/272,292

(22) Filed: Nov. 17, 2008

(65) Prior Publication Data

US 2009/0074636 A1 Mar. 19, 2009

Related U.S. Application Data

(62) Division of application No. 11/178,158, filed on Jul. 8, 2005, now Pat. No. 7,465,388.

(51) Int. Cl.
*F28D 7/00* (2006.01)
*F28C 3/06* (2006.01)
*B01D 3/00* (2006.01)

(52) U.S. Cl. ..... 422/201; 422/198; 422/200; 196/102; 196/138; 196/140; 208/48 Q

(58) Field of Classification Search ..... 422/198, 422/200, 201; 196/102, 138, 140; 208/48 Q
See application file for complete search history.

(56) References Cited

U.S. PATENT DOCUMENTS 2,343,192 A 2/1944 Kuhn
2,695,264 A 11/1954 Taff et al.
2,901,418 A 8/1959 Pappas
3,060,116 A 10/1962 Hardin et al.
3,498,906 A 3/1970 Bogart et al.
3,529,030 A 9/1970 Chin
3,593,968 A 7/1971 Geddes
3,647,907 A 3/1972 Sato et al.
3,676,519 A 7/1972 Dorn et al.
3,907,661 A 9/1975 Gwyn et al.
3,923,921 A 12/1975 Kohfeldt
3,959,420 A 5/1976 Geddes et al.
4,107,226 A 8/1978 Ennis, Jr. et al.

(Continued)

FOREIGN PATENT DOCUMENTS

EP 0 031 609 7/1981

(Continued)

OTHER PUBLICATIONS

Lohr et al., "*Steam-cracker Economy Keyed to Quenching*", Oil Gas Journal, vol. 76 (No. 20), pp. 63-68, (1978).

(Continued)

*Primary Examiner* — Walter D Griffin
*Assistant Examiner* — Lessanework Seifu

(57) ABSTRACT

A method is disclosed for treating the effluent from a hydrocarbon pyrolysis process unit to recover heat and remove tar therefrom. The method comprises passing the gaseous effluent to at least one primary heat exchanger, thereby cooling the gaseous effluent and generating high pressure steam. Thereafter, the gaseous effluent is passed through at least one secondary heat exchanger having a heat exchange surface maintained at a temperature such that part of the gaseous effluent condenses to form in situ a liquid coating on said surface, thereby further cooling the remainder of the gaseous effluent to a temperature at which tar, formed by the pyrolysis process, condenses. The condensed tar is then removed from the gaseous effluent in at least one knock-out drum.

13 Claims, 4 Drawing Sheets

U.S. PATENT DOCUMENTS

| | | | |
|---|---|---|---|
| 4,121,908 | A | 10/1978 | Raab et al. |
| 4,150,716 | A | 4/1979 | Ozaki et al. |
| 4,166,830 | A | 9/1979 | Guth et al. |
| 4,233,137 | A | 11/1980 | Ozaki et al. |
| 4,279,733 | A | 7/1981 | Gwyn |
| 4,279,734 | A | 7/1981 | Gwyn |
| 4,420,343 | A | 12/1983 | Sliwka |
| 4,444,697 | A | 4/1984 | Gater et al. |
| 4,446,003 | A | 5/1984 | Burton et al. |
| 4,457,364 | A | 7/1984 | DiNicolantonio et al. |
| 4,520,760 | A | 6/1985 | Covell |
| 4,581,899 | A | 4/1986 | von Klock et al. |
| 4,614,229 | A | 9/1986 | Oldweiler |
| 4,702,818 | A | 10/1987 | Oyamoto et al. |
| 4,945,978 | A | 8/1990 | Herrmann |
| 5,092,981 | A | 3/1992 | Russo |
| 5,107,921 | A | 4/1992 | Tsai |
| 5,139,650 | A | 8/1992 | Lenglet |
| 5,147,511 | A | 9/1992 | Woebcke |
| 5,215,649 | A | 6/1993 | Grenoble et al. |
| 5,271,827 | A | 12/1993 | Woebcke |
| 5,294,347 | A | 3/1994 | Byrne et al. |
| 5,324,486 | A | 6/1994 | Russo |
| 5,579,831 | A | 12/1996 | Brucher |
| 5,690,168 | A | 11/1997 | Cizmar et al. |
| 5,756,055 | A | 5/1998 | Kelly et al. |
| 6,148,908 | A | 11/2000 | Brucher |
| 6,183,626 | B1 | 2/2001 | Lenglet et al. |
| 6,271,431 | B1 | 8/2001 | Busson et al. |
| 6,626,424 | B2 | 9/2003 | Ngan et al. |
| 2003/0031612 | A1 | 2/2003 | Raynal et al. |

FOREIGN PATENT DOCUMENTS

| | | |
|---|---|---|
| EP | 0 205 205 | 12/1986 |
| EP | 1 063 273 | 12/2000 |
| GB | 1233795 | 5/1971 |
| GB | 1309309 | 3/1973 |
| GB | 1390382 | 4/1975 |
| JP | 2001/040366 | 2/2001 |
| WO | WO 93/12200 | 6/1993 |
| WO | WO 97/13097 | 4/1997 |
| WO | WO 00/56841 | 9/2000 |

OTHER PUBLICATIONS

Kister, Henry Z., *Distillation Design*, Chapter 6 "Tray Design and Operation", pp. 259-363, Chapter 8 "Packing Design and Operation", pp. 421-521, McGraw-Hill, Inc., (1992).

Herrmann, H. & Burghardt, W., "*Latest Developments in Transfer Line Exchanger Design for Ethylene Plants*", Schmidt'sche-Heissdampf-Gesellschaft, pp. 193-228, Apr. 1994.

Mukherjee, R., "*Effectively Design Shell-and-Tube Heat Exchangers*", 94 Chem. Engr. Progress, pp. 21-37, (1998).

METHOD FOR PROCESSING HYDROCARBON PYROLYSIS EFFLUENT

PRIORITY CLAIM

This application is a divisional of U.S. application Ser. No. 11/178,158, filed Jul. 8, 2005 now U.S. Pat. No. 7,465,388, which is hereby incorporated by reference.

FIELD OF THE INVENTION

The present invention is directed to a method for processing the gaseous effluent from hydrocarbon pyrolysis units.

BACKGROUND OF THE INVENTION

The production of light olefins (ethylene, propylene and butenes) from various hydrocarbon feedstocks utilizes the technique of pyrolysis, or steam cracking. Pyrolysis involves heating the feedstock sufficiently to cause thermal decomposition of the larger molecules.

In the steam cracking process, it is desirable to maximize the recovery of useful heat from the process effluent stream exiting the cracking furnace. Effective recovery of this heat is one of the key elements of a steam cracker's energy efficiency.

The steam cracking process, however, also produces molecules which tend to combine to form high molecular weight materials known as tar. Tar is a high-boiling point, viscous, reactive material that, under certain conditions, can foul heat exchange equipment, rendering heat exchangers ineffective. The fouling propensity can be characterized by three temperature regimes.

Above the hydrocarbon dew point (the temperature at which the first drop of liquid condenses), the fouling tendency is relatively low. Vapor phase fouling is generally not severe, and there is no liquid present that could cause fouling. Appropriately designed heat exchangers, typically transfer line heat exchangers, are therefore capable of recovering heat in this regime with minimal fouling.

Between the hydrocarbon dew point and the temperature at which steam cracked tar is fully condensed, the fouling tendency is high. In this regime, the heaviest components in the stream condense. These components are believed to be sticky and/or viscous, causing them to adhere to surfaces. Furthermore, once this material adheres to a surface, it is subject to thermal degradation that hardens it and makes it more difficult to remove.

At or below the temperature at which steam cracked tar is fully condensed, the fouling tendency is relatively low. In this regime, the condensed material is fluid enough to flow readily at the conditions of the process, and fouling is generally not a serious problem.

One technique used to cool pyrolysis unit effluent and remove the resulting tar employs heat exchangers followed by a water quench tower in which the condensibles are removed. This technique has proven effective when cracking light gases, primarily ethane, propane and butane, because crackers that process light feeds, collectively referred to as gas crackers, produce relatively small quantities of tar. As a result, heat exchangers can efficiently recover most of the valuable heat without fouling and the relatively small amount of tar can be separated from the water quench albeit with some difficulty.

This technique is, however, not satisfactory for use with steam crackers that crack naphthas and heavier feedstocks, collectively referred to as liquid crackers, since liquid crackers generate much larger quantities of tar than gas crackers. Heat exchangers can be used to remove some of the heat from liquid cracking, but only down to the temperature at which tar begins to condense. Below this temperature, conventional heat exchangers cannot be used because they would foul rapidly from accumulation and thermal degradation of tar on the heat exchanger surfaces. In addition, when the pyrolysis effluent from these feedstocks is quenched, some of the heavy oils and tars produced have approximately the same density as water and can form stable oil/water emulsions. Moreover, the larger quantity of heavy oils and tars produced by liquid cracking would render water quench operations ineffective, making it difficult to raise steam from the condensed water and to dispose of excess quench water and the heavy oil and tar in an environmentally acceptable manner.

Accordingly in most commercial liquid crackers, cooling of the effluent from the cracking furnace is normally achieved using a system of transfer line heat exchangers, a primary fractionator, and a water quench tower or indirect condenser. For a typical naphtha feedstock, the transfer line heat exchangers cool the process stream to about 700° F. (370° C.), efficiently generating super-high pressure steam which can be used elsewhere in the process. The primary fractionator is normally used to condense and separate the tar from the lighter liquid fraction, known as pyrolysis gasoline, and to recover the heat between about 700° F. (370° C.) and about 200° F. (90° C.). The water quench tower or indirect condenser further cools the gas stream exiting the primary fractionator to about 104° F. (40° C.) to condense the bulk of the dilution steam present and to separate pyrolysis gasoline from the gaseous olefinic product, which is then sent to a compressor.

The primary fractionator, however, is a very complex piece of equipment which typically includes an oil quench section, a primary fractionator tower and one or more external oil pumparound loops. At the quench section, quench oil is added to cool the effluent stream to about 400 to 554° F. (200 to 290° C.), thereby condensing tar present in the stream. In the primary fractionator tower, the condensed tar is separated from the remainder of the stream, heat is removed in one or more pumparound zones by circulating oil and a pyrolysis gasoline fraction is separated from heavier material in one or more distillation zones. In the one or more external pumparound loops, oil, which is withdrawn from the primary fractionator, is cooled using indirect heat exchangers and then returned to the primary fractionator or the direct quench point.

The primary fractionator with its associated pumparounds is the most expensive component in the entire cracking system. The primary fractionator tower itself is the largest single piece of equipment in the process, typically being about twenty-five feet in diameter to and over a hundred feet high for a medium size liquid cracker. The tower is large because it is in effect fractionating two minor components, tar and pyrolysis gasoline, in the presence of a large volume of low pressure gas. The pumparound loops are likewise large, handling over 3 million pounds per hour of circulating oil in the case of a medium size cracker. Heat exchangers in the pumparound circuit are necessarily large because of high flow rates, close temperature approaches needed to recover the heat at useful levels, and allowances for fouling.

In addition, the primary fractionator has a number of other limitations and problems. In particular, heat transfer takes place twice, i.e., from the gas to the pumparound liquid inside the tower and then from the pumparound liquid to the external cooling service. This effectively requires investment in two heat exchange systems, and imposes two temperature approaches (or differentials) on the removal of heat, thereby reducing thermal efficiency.

Moreover, despite the fractionation that takes place between the tar and gasoline streams, both streams often need to be processed further. Sometimes the tar needs to be stripped to remove light components, whereas the gasoline may need to be refractionated to meet its end point specification.

Further, the primary fractionator tower and its pumparounds are prone to fouling. Coke accumulates in the bottom section of the tower and must eventually be removed during plant turnarounds. The pumparound loops are also subject to fouling, requiring removal of coke from filters and periodic cleaning of fouled heat exchangers. Trays and packing in the tower are sometimes subject to fouling, potentially limiting plant production. The system also contains a significant inventory of flammable liquid hydrocarbons, which is not desirable from an inherent safety standpoint.

The present invention seeks to provide a simplified method for treating pyrolysis unit effluent, particularly the effluent from the steam cracking of naphthas, which maximizes recovery of the useful heat energy without fouling of the cooling equipment and which obviates the need for a primary fractionator tower and its ancillary equipment.

U.S. Pat. Nos. 4,279,733 and 4,279,734 propose cracking methods using a quencher, indirect heat exchanger and fractionator to cool effluent, resulting from steam cracking.

U.S. Pat. Nos. 4,150,716 and 4,233,137 propose a heat recovery apparatus comprising a pre-cooling zone where the effluent resulting from steam cracking is brought into contact with a sprayed quenching oil, a heat recovery zone and a separating zone.

Lohr et al., "Steam-cracker Economy Keyed to Quenching," Oil & Gas Journal, Vol. 76, (No. 20), pp. 63-68, (1978), proposes a two-stage quenching involving indirect quenching with a transfer line heat exchanger to produce high-pressure steam along with direct quenching with a quench oil to produce medium-pressure steam.

U.S. Pat. Nos. 5,092,981 and 5,324,486 propose a two-stage quench process for effluent resulting from steam cracking furnace comprising a primary transfer line exchanger which functions to rapidly cool furnace effluent and to generate high temperature steam and a secondary transfer line exchanger which functions to cool the furnace effluent to as low a temperature as possible consistent with efficient primary fractionator or quench tower performance and to generate medium to low pressure steam.

U.S. Pat. No. 5,107,921 proposes transfer line exchangers having multiple tube passes of different tube diameters. U.S. Pat. No. 4,457,364 proposes a close-coupled transfer line heat exchanger unit.

U.S. Pat. No. 3,923,921 proposes a naphtha steam cracking process comprising passing effluent through a transfer line exchanger to cool the effluent and thereafter through a quench tower.

WO 93/12200 proposes a method for quenching the gaseous effluent from a hydrocarbon pyrolysis unit by passing the effluent through transfer line exchangers and then quenching the effluent with liquid water so that the effluent is cooled to a temperature in the range of 220° F. to 266° F. (105° C. to 130° C.), such that heavy oils and tars condense, as the effluent enters a primary separation vessel. The condensed oils and tars are separated from the gaseous effluent in the primary separation vessel and the remaining gaseous effluent is passed to a quench tower where the temperature of the effluent is reduced to a level at which the effluent is chemically stable.

EP 205 205 proposes a method for cooling a fluid such as a cracked reaction product by using transfer line exchangers having two or more separate heat exchanging sections.

U.S. Pat. No. 5,294,347 proposes that in ethylene manufacturing plants, a water quench column cools gas leaving a primary fractionator and that in many plants, a primary fractionator is not used and the feed to the water quench column is directly from a transfer line exchanger.

JP 2001-40366 proposes cooling mixed gas in a high temperature range with a horizontal heat exchanger and then with a vertical heat exchanger having its heat exchange planes installed in the vertical direction. A heavy component condensed in the vertical exchanger is thereafter separated by distillation at downstream refining steps.

WO 00/56841; GB 1,390,382; GB 1,309,309; and U.S. Pat. Nos. 4,444,697; 4,446,003; 4,121,908; 4,150,716; 4,233,137; 3,923,921; 3,907,661; and 3,959,420; propose various apparatus for quenching a hot cracked gaseous stream wherein the hot gaseous stream is passed through a quench pipe or quench tube wherein a liquid coolant (quench oil) is injected.

SUMMARY OF THE INVENTION

In one aspect, the present invention is directed to a method for treating gaseous effluent from a hydrocarbon pyrolysis process unit, the method comprising:

(a) passing the gaseous effluent through at least one primary heat exchanger, thereby cooling the gaseous effluent and generating high pressure steam;

(b) passing the gaseous effluent from step (a) through at least one secondary heat exchanger having a heat exchange surface maintained at a temperature such that part of the gaseous effluent condenses to form a liquid coating on said surface, thereby further cooling the remainder of the gaseous effluent to a temperature at which tar, formed by the pyrolysis process, condenses; and (c) separating the condensed tar and the gaseous effluent.

In a preferred embodiment, the heat exchange surface is maintained at a temperature below about 599° F. (315° C.), say at a temperature between about 300 and 500° F. (149° C. to 260° C.).

In a further aspect, the invention resides in a method for treating gaseous effluent from a hydrocarbon pyrolysis process unit, the method comprising:

(a) passing the gaseous effluent through at least one primary heat exchanger, thereby cooling the gaseous effluent and generating high pressure steam;

(b) passing the gaseous effluent from (a) through at least one secondary heat exchanger having a heat exchange surface maintained at a temperature such that part of the gaseous effluent condenses to form a liquid coating on said surface, thereby further cooling the remainder of the gaseous effluent to a temperature at which at least a portion of the tar, formed by the pyrolysis process, in said gaseous effluent condenses;

(c) passing the effluent from step (b) through at least one knock-out drum, where the condensed tar and the gaseous effluent separate; and then (d) reducing the temperature of the gaseous effluent from step (c) to less than 212° F. (100° C.); the method being carried out in the absence of a primary fractionator.

In yet a further aspect, the invention resides in a hydrocarbon cracking apparatus comprising:

(a) a reactor for pyrolyzing a hydrocarbon feedstock, the reactor having an outlet through which gaseous pyrolysis effluent can exit the reactor;

(b) at least one primary heat exchanger connected to and downstream of the reactor outlet for cooling the gaseous effluent;

(c) at least one secondary heat exchanger connected to and downstream of the at least one primary heat exchanger for further cooling said gaseous effluent, said at least one secondary heat exchanger having a heat exchange surface which is maintained, in use, at a temperature such that part of the gaseous effluent condenses to form a liquid coating on said surface, thereby cooling the remainder of the gaseous effluent to a temperature at which at least a portion of the tar, formed during pyrolysis, in said gaseous effluent condenses; and (d) means for separating the condensed tar and gaseous effluent.

DETAILED DESCRIPTION OF THE EMBODIMENTS

Figure 1:
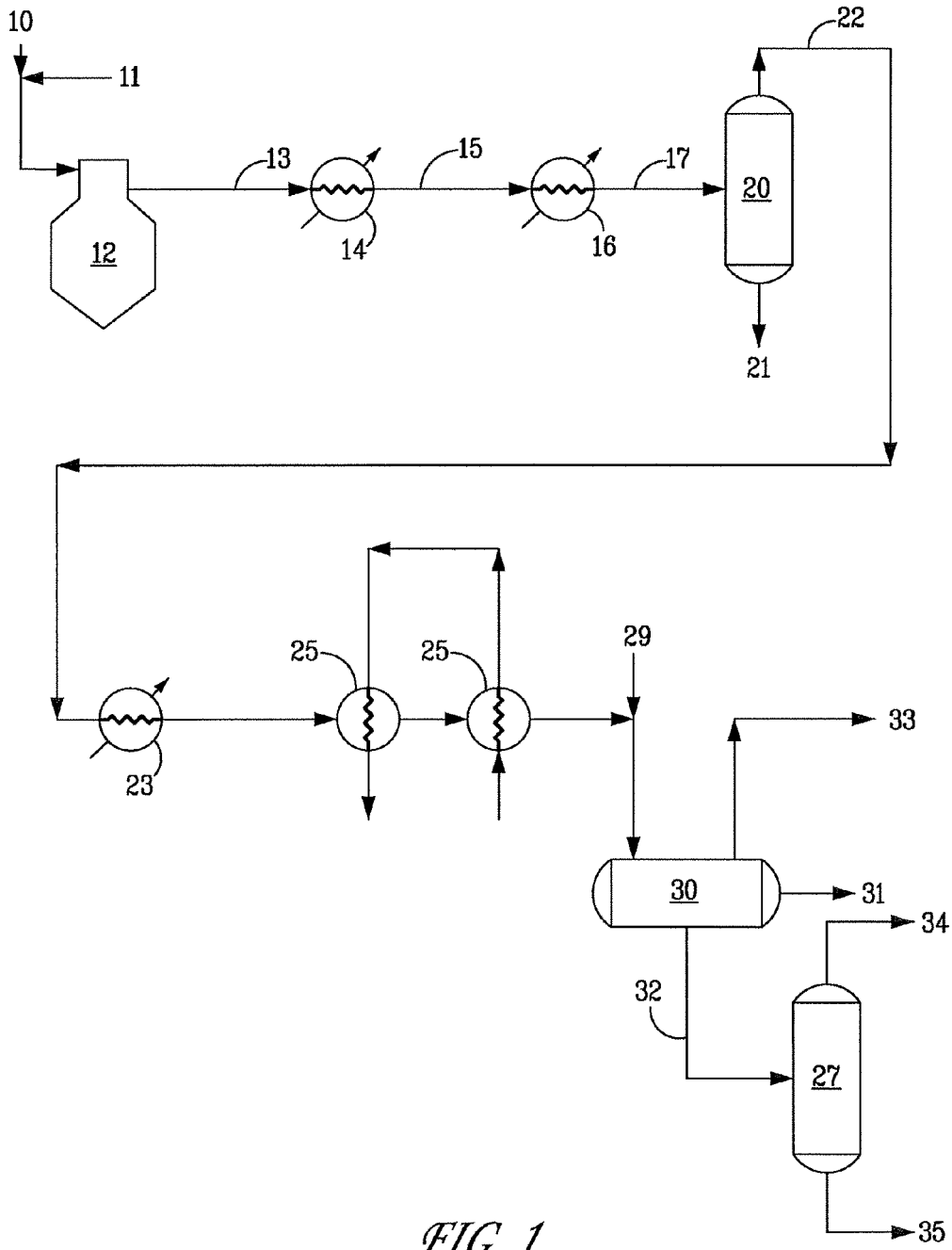
FIG. 1 is a schematic flow diagram of a method according to one example of the present invention of treating the gaseous effluent from the cracking of a naphtha feed.

The present invention provides a low cost way of treating the gaseous effluent stream from a hydrocarbon pyrolysis reactor so as to remove and recover heat therefrom and to separate $C_5$+ hydrocarbons from the desired $C_2$-$C_4$ olefins in the effluent, without the need for a primary fractionator and while minimizing fouling of the cooling equipment with tar.

Typically, the effluent used in the method of the invention is produced by pyrolysis of a hydrocarbon feed boiling in a temperature range from about 104° F. to about 356° F. (40° C. to about 180° C.), such as naphtha. The temperature of the gaseous effluent at the outlet from the pyrolysis reactor is normally in the range of about 1400° F. to about 1706° F. (760° C. to about 930° C.) and the invention provides a method of cooling the effluent to a temperature at which the desired $C_2$-$C_4$ olefins can be compressed efficiently, generally less than 212° F. (100° C.), for example less than 167° F. (75° C.), such as less than 140° F. (60° C.) and typically 68° F. to 122° F. (20 to 50° C.).

In particular, the present invention relates to a method for treating the gaseous effluent from the naphtha cracking unit, which method comprises passing the effluent through at least one primary heat exchanger, which is capable of recovering heat from the effluent down to a temperature where fouling is incipient. If needed, this heat exchanger can be periodically cleaned by steam decoking, steam/air decoking, or mechanical cleaning. Conventional indirect heat exchangers, such as tube-in-tube exchangers or shell and tube exchangers, may be used in this service. The primary heat exchanger cools the process stream to a temperature between about 644° F. and about 1202° F. (340° C. and about 650° C.), such as about 700° F. (370° C.), using water as the cooling medium and generates super-high pressure steam, typically at about 1500 psig (10400 kPa).

On leaving the primary heat exchanger, the cooled gaseous effluent is still at a temperature above the hydrocarbon dew point (the temperature at which the first drop of liquid condenses) of the effluent. For a typical naphtha feed under certain cracking conditions, the hydrocarbon dewpoint of the effluent stream is about 581° F. (305° C.). Above the hydrocarbon dew point, the fouling tendency is relatively low, i.e., vapor phase fouling is generally not severe, and there is no liquid present that could cause fouling.

After leaving the primary heat exchanger, the effluent is then passed to at least one secondary heat exchanger which is designed and operated such that it includes a heat exchange surface cool enough to condense part of the effluent and generate a liquid hydrocarbon film at the heat exchange surface. The liquid film is generated in situ and is preferably at or below the temperature at which tar is fully condensed, typically at about 302° F. to about 599° F. (150° C. to about 315° C.), such as at about 446° F. (230° C.). This is ensured by proper choice of cooling medium and exchanger design. Because the main resistance to heat transfer is between the bulk process stream and the film, the film can be at a significantly lower temperature than the bulk stream. The film effectively keeps the heat exchange surface wetted with fluid material as the bulk stream is cooled, thus preventing fouling. Such a secondary exchanger must cool the process stream continuously to the temperature at which tar is produced. If the cooling is stopped before this point, fouling is likely to occur because the process stream would still be in the fouling regime.

After passage through the secondary heat exchanger, the cooled effluent is fed to a tar knock-out drum where the condensed tar is separated from the effluent stream. If desired, multiple knock-out drums may be connected in parallel such that individual drums can be taken out of service and cleaned while the plant is operating. The tar removed at this stage of the process typically has an initial boiling point of at least 302° F. (150° C.).

The effluent entering the tar knock-out drum(s) should be at a sufficiently low temperature, typically at about 3024° F. (150° C.) to about 599° F. (315° C.), such as at about 446° F. (230° C.), that the tar separates rapidly in the knock-out drum(s). Thus, depending on the severity of operation of the heat exchanger(s), the effluent stream, after it passes from the heat exchanger(s) and before it enters the tar knock-out drum, can be further cooled by direct injection of a small amount of water.

After removal of the tar in the tar knock-out drum(s), the gaseous effluent stream is subjected to an additional cooling sequence by which additional heat energy is recovered from the effluent and the temperature of the effluent is reduced to a point at which the lower olefins in the effluent can be efficiently compressed, typically 68° F. to 122° F. (20 to 50° C.) and preferably about 104° F. (40° C.). The additional cooling sequence includes passing the effluent through one or more cracked gas coolers and then through either a water quench tower or at least one indirect partial condenser so as to condense the pyrolysis gasoline and water in the effluent. The condensate is then separated into an aqueous fraction and a pyrolysis gasoline fraction and the pyrolysis gasoline fraction is distilled to lower its final boiling point. Typically, the pyrolysis gasoline fraction condensed from the effluent stream has an initial boiling point of less than 302° F. (150° C.) and final boiling point in excess of 500° F. (260° C.), such as of the order of 842° F. (450° C.) whereas, after distillation, it typically has a final boiling point of 400 to 446° F. (200 to 230° C.).

It will therefore be seen that in the method of the invention, the pyrolysis effluent is cooled to a temperature at which the lower olefins in the effluent can be efficiently compressed without undergoing a fractionation step. Thus the method of the invention obviates the need for a primary fractionator, the most expensive component of the heat removal system of a conventional naphtha cracking unit. As a result, the pyrolysis gasoline fraction contains some heavier components that would not have been present if the entire gaseous effluent had been passed through a primary fractionator. However, these heavier components are removed in a simple distillation tower (typically including 15 trays, a reboiler, and a condenser) which can be constructed at a fraction of the cost of a conventional primary fractionator.

The method of the invention achieves several advantages in addition to the reduced capital and operating costs associated with removal of the primary fractionator. The use of at least one primary heat exchanger and of at least one secondary heat exchanger maximizes the value of recovered heat. Further, additional useful heat is recovered after the tar is separated out. Tar and coke are removed from the process as early as possible in a dedicated vessel, minimizing fouling and simplifying coke removal from the process. Liquid hydrocarbon inventory is greatly reduced and pumparound pumps are eliminated. Fouling of primary fractionator trays and pumparound exchangers is eliminated. Safety valve relieving rates and associated flaring in the event of a cooling water or power failure may be reduced.

Where the additional cooling sequence involves passing the effluent through at least one indirect partial condenser, this is conveniently arranged to lower the temperature of the effluent to about 68° F. to about 122° F. (20° C. to about 50° C.), typically about 104° F. (40° C.). By operating at such a low temperature, as compared with the temperature of about 176° F. (80° C.) normally achieved with a water quench tower, additional light hydrocarbons can condense, thereby reducing the density of the hydrocarbon phase and improving the separation of pyrolysis gasoline from water. Such separation typically occurs in a settling drum.

To further reduce the density of the condensed hydrocarbon, an embodiment of the present invention contemplates the addition of light pyrolysis gasoline to the condensed pyrolysis gasoline stream. Several light fractions of pyrolysis gasoline are normally produced in a naphtha steam cracker, for example, a fraction containing mainly $C_5$ and light $C_6$ components and a benzene concentrate fraction. These fractions have lower densities than that of the total condensed pyrolysis gasoline stream. Adding such a stream to the condensed pyrolysis gasoline stream will lower its density, thereby improving separation of the hydrocarbon phase from the water phase. The ideal recycle fraction will maximize the reduction in density of the condensed pyrolysis gasoline with minimal vaporization. It may be added directly to the quench water settler or to an upstream location.

In one embodiment of the invention, the low level heat removed from the gas effluent in the cracked gas cooler(s) is used to heat deaerator feed water. Typically demineralized water and steam condensate are heated to about 266° F. (130° C.) using low pressure steam in a deaerator where air is stripped out. To achieve effective stripping, the maximum temperature of the water entering the deaerator is generally limited to 20° F. to 50° F. (11° to 28° C.) below the deaerator temperature, depending on the design of the deaerator system. This allows water to be heated to 212° F. to 239° F. (100° C. to 115° C.) using indirect heat exchange with the cooling cracked gas stream. Cooling water exchangers could be used as needed to supplement cooling of the cracked gas stream. By way of example, in one commercial olefins plant, about 816 klb/hr of demineralized water at 84° F. (29° C.) and 849 klb/hr of steam condensate at 167° F. (75° C.) are currently heated to 268° F. (131° C.) using 242 klb/hr of low pressure steam. These streams could potentially be heated to 241° F. (116° C.) using heat recovered from cracked gas. This would reduce the deaerator steam requirement from 242 klb/hr to 46 klb/hr, for a saving of 196 klb/hr of low pressure steam, and would reduce the cooling tower duty by about 189 MBTU/hr.

The invention will now be more particularly described with reference to the accompanying drawings.

Figure 2:
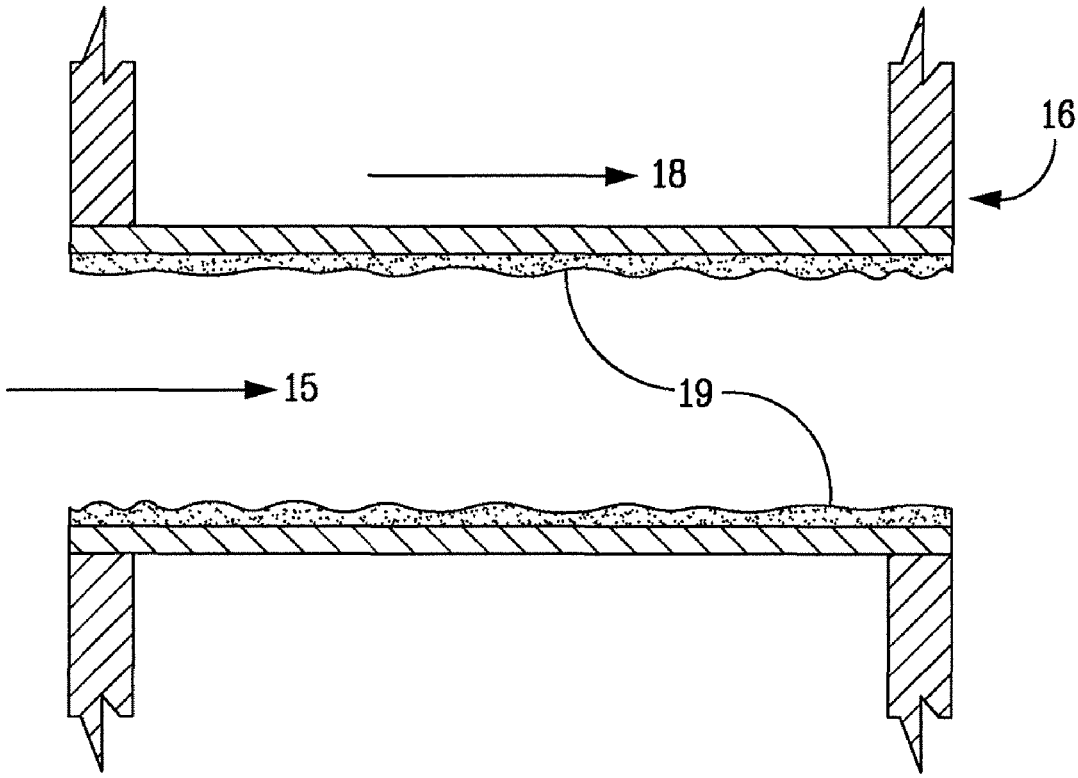
FIG. 2 is a sectional view of one tube of a wet transfer line heat exchanger employed in the method shown in FIG. 1.

Referring to FIGS. 1 and 2, in the method shown a hydrocarbon feed 10 comprising naphtha and dilution steam 11 is fed to a steam cracking reactor 12 where the hydrocarbon feed is heated to cause thermal decomposition of the feed to produce lower molecular weight hydrocarbons, such as $C_2$-$C_4$ olefins. The pyrolysis process in the steam cracking reactor also produces some tar.

Gaseous pyrolysis effluent 13 exiting the steam cracking furnace initially passes through at least one primary transfer line heat exchanger 14 which cools the effluent to about 700° F. (370° C.). After leaving the primary heat exchanger 14, the cooled effluent stream 15 is then fed to at least one secondary heat exchanger 16, where the effluent is cooled to about 446° F. (230° C.) on the tube side of the heat exchanger 16 while boiler feed water 18 (FIG. 2) is preheated from about 261° F. (127° C.) to about 410° F. (210° C.) on the shell side of the heat exchanger 16. In this way, the heat exchange surfaces of the heat exchanger 16 are cool enough to generate a liquid film 19 in situ at the surface of the tube, the liquid film resulting from condensation of the gaseous effluent.

While FIG. 2 depicts co-current flow of the effluent stream 15 and boiler feed water 18 to minimize the temperature of the liquid film 19 at the process side inlet; other arrangements of flow are possible, including countercurrent flow. Because heat transfer is rapid between the boiler feed water and the tube metal, the tube metal is just slightly hotter than the boiler feed water 18 at any point in the heat exchanger 16. Heat transfer is also rapid between the tube metal and the liquid film 19 on the process side, and therefore the film temperature is just slightly hotter than the tube metal temperature at any point in heat exchanger 16. Along the entire length of the heat exchanger 16, the film temperature is generally below about 446° F. (230° C.), the temperature at which tar is fully condensed from this particular feed at these conditions. This ensures that the film is completely fluid, and thus fouling is avoided.

Preheating high pressure boiler feed water in the heat exchanger 16 is one of the most efficient uses of the heat generated in the pyrolysis unit. Following deaeration, boiler feed water is typically available at about 261° F. (127° C.). Boiler feed water from the deaerator can therefore be preheated in the wet transfer line heat exchanger 16 and thereafter sent to the at least one primary transfer line heat exchanger 14. All of the heat used to preheat boiler feed water will increase high pressure steam production.

On leaving the heat exchanger 16, the cooled gaseous effluent is at a temperature where the tar condenses and is then passed into at least one tar knock-out drum 20 where the effluent is separated into a tar and coke fraction 21 and a gaseous fraction 22.

Thereafter, the gaseous fraction 22 passes through one or more partial condensers 23 and 25, where the fraction is cooled to a temperature of about 68° F. to about 122° F. (20° C. to about 50° C.), such as about 104° F. (40° C.) by indirect heat transfer with deaerator feed water and then cooling water as the cooling medium. The cooled effluent, containing condensed pyrolysis gasoline and water, is then mixed with a light pyrolysis gasoline stream 29 and passed to a quench water settling drum 30. In the settling drum 30, the condensate separates into a hydrocarbon fraction 32, which is fed to a distillation tower 27, an aqueous fraction 31, which is fed to a sour water stripper (not shown), and a gaseous overhead fraction 33, which can be fed directly to a compressor. In the distillation tower 27, the hydrocarbon fraction 32 is fractionated into a pyrolysis gasoline fraction 34, typically having a final boiling point of 356 to 446° F. (180 to 230° C.) and a steam cracked gas oil fraction 35, typically having a final boiling point of 500 to 1004° F. (260 to 540° C.).

The hardware for the heat exchanger 16 may be similar to that of a secondary transfer line exchanger often used in gas cracking service. A shell and tube exchanger could be used. The process stream could be cooled on the tube side in a single pass, fixed tubesheet arrangement. A relatively large tube diameter would allow coke produced upstream to pass through the exchanger without plugging. The design of the heat exchanger 16 may be arranged to minimize the temperature and maximize thickness of the liquid film 19, for example, by adding fins to the outside surface of the heat exchanger tubes. Boiler feed water could be preheated on the shell side in a single pass arrangement. Alternatively, the shell side and tube side services could be switched. Either co-current or counter-current flow could be used, provided that the film temperature is kept low enough along the length of the exchanger.

Figure 3:
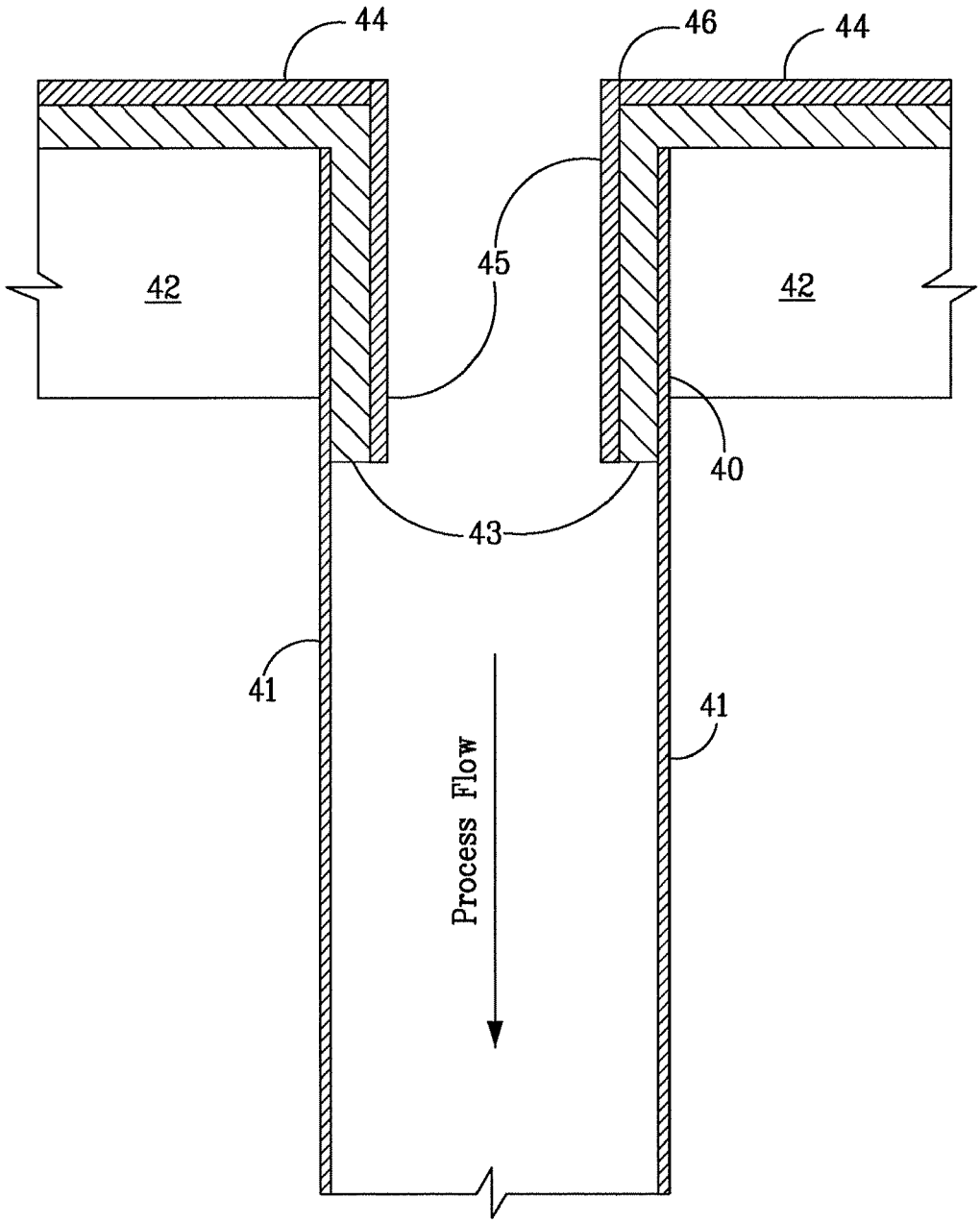
FIG. 3 is a sectional view of the inlet transition piece of a shell-and-tube wet transfer line heat exchanger employed in the method shown in FIG. 1.

For example, the inlet transition piece of a suitable shell-and-tube wet transfer line exchanger is shown in FIG. 3. A heat exchanger tube 41 is fixed in an aperture 40 in a tubesheet 42. A tube insert or ferrule 45 is fixed in an aperture 46 in a false tubesheet 44 positioned adjacent tubesheet 42 such that the ferrule 45 extends into the heat exchanger tube 41 with a thermally insulating material 43 being placed between the tubesheet 42 and the false tubesheet 44 and between the heat exchanger tube 41 and the ferrule 45. With this arrangement, the false tubesheet 44 and ferrule 45 operate at a temperature very close to the process inlet temperature while the heat exchanger tube 41 operates at a temperature very close to that of the cooling medium. Accordingly, little fouling will occur on the false tubesheet 44 and the ferrule 45 because they operate above the dew point of the pyrolysis effluent. Similarly, little fouling will occur on the surface of the heat exchanger tube 41 because it operates below the temperature at which the tar fully condenses. This arrangement provides a very sharp transition in surface temperatures to avoid the fouling temperature regime between the hydrocarbon dew point and the temperature at which the tar fully condenses.

Alternatively, the hardware for the secondary transfer line exchanger may be similar to that of a close coupled primary transfer line exchanger. A tube-in-tube exchanger could be used. The process stream could be cooled in the inner tube. A relatively large inner tube diameter would allow coke produced upstream to pass through the exchanger without plugging. Boiler feed water could be preheated in the annulus between the outer and inner tubes. Either co-current or counter-current flow could be used, provided that the film temperature is kept low enough along the length of the exchanger.

Figure 4:
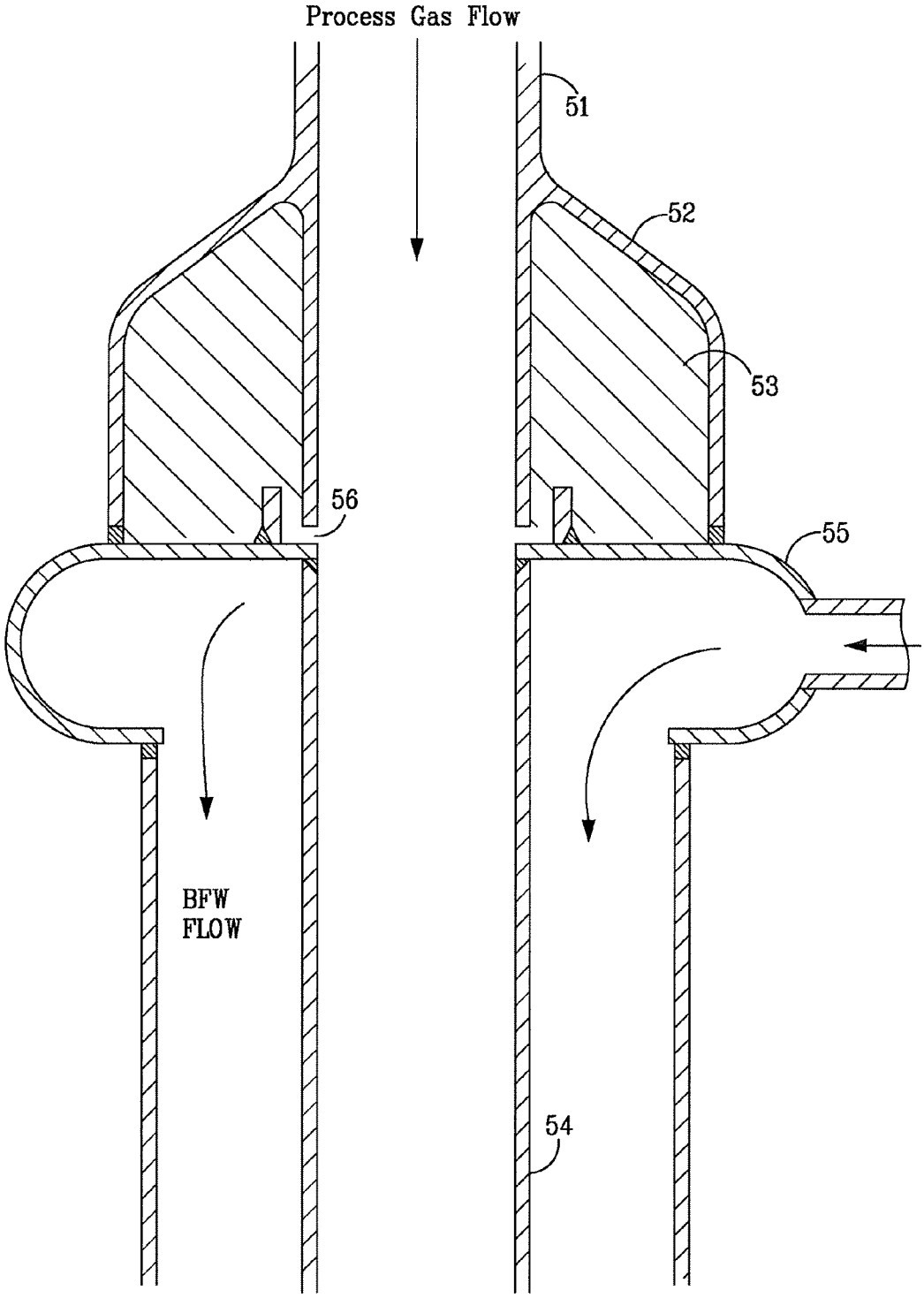
FIG. 4 is a sectional view of the inlet transition piece of a tube-in-tube wet transfer line heat exchanger employed in the method shown in FIG. 1.

For example, the inlet transition piece of a suitable tube-in-tube wet transfer line exchanger is shown in FIG. 4. An exchanger inlet line 51 is attached to swage 52 which is attached to a boiler feed water inlet chamber 55. Insulating material 53 fills the annular space between the exchanger inlet line 51, swage 52, and boiler feed water inlet chamber 55. Heat exchanger tube 54 is attached to boiler feed water inlet chamber 55 such that there is a small gap 56 between the end of exchanger inlet line 51 and the beginning of heat exchanger tube 54 to allow for thermal expansion. A similar arrangement, although incorporating a wye-piece in the process gas flow piping, is described in U.S. Pat. No. 4,457,364. The entire exchanger inlet line 51 operates at a temperature very close to the process temperature while the exchanger tube 54 operates at a temperature very close to that of the cooling medium. Accordingly, little fouling will occur on the surface of the exchanger inlet line 51 because it operates above the dew point of the pyrolysis effluent. Similarly, little fouling will occur on the heat exchanger tube 54 because it operates below the temperature at which the tar fully condenses. Again this arrangement provides a very sharp transition in surface temperatures to avoid the fouling temperature regime between the hydrocarbon dew point and the temperature at which the tar fully condenses.

The secondary heat exchanger may be oriented such that the process flow is either substantially horizontal, substantially vertical upflow, or, preferably, substantially vertical is downflow. A substantially vertical downflow system helps ensure that the liquid film formed in situ remains fairly uniform over the entire inside surface of the heat exchanger tube, thereby minimizing fouling. In contrast, in a horizontal orientation the liquid film will tend to be thicker at the bottom of the heat exchanger tube and thinner at the top because of the effect of gravity. In a substantially vertical upflow arrangement, the liquid film may tend to separate from the tube wall as gravity tends to pull the liquid film downward. Another practical reason favoring a substantially vertical downflow orientation is that the inlet stream exiting the primary heat exchanger is often located high up in the furnace structure, while the outlet stream is desired at a lower elevation. A downward flow secondary heat exchanger would naturally provide this transition in elevation for the stream.

The secondary heat exchanger may be designed to allow decoking of the exchanger using steam or a mixture of steam and air in conjunction with the furnace decoking system. When the furnace is decoked, using either steam or a mixture of steam and air, the furnace effluent would first pass through the primary heat exchanger and then through the secondary heat exchanger prior to being disposed of to the decoke effluent system. With this feature, it is advantageous for the inside diameter of the secondary heat exchanger tubes to be greater than or equal to the inside diameter of the primary heat exchanger tubes. This ensures that any coke present in the effluent of the primary heat exchanger will readily pass through the secondary heat exchanger tube without causing any restrictions.

While the invention has been described in connection with certain preferred embodiments so that aspects thereof may be more fully understood and appreciated, it is not intended to limit the invention to these particular embodiments. On the contrary, it is intended to cover all alternatives, modifications and equivalents as may be included within the scope of the invention as defined by the appended claims.

What is claimed is:

1. Hydrocarbon cracking apparatus comprising:

(a) a reactor for pyrolyzing a hydrocarbon feedstock, the reactor having an outlet through which gaseous pyrolysis effluent can exit the reactor;

(b) at least one primary heat exchanger connected to and downstream of the reactor outlet for cooling the gaseous effluent;

(c) at least one secondary heat exchanger connected to and downstream of the at least one primary heat exchanger for further cooling said gaseous effluent, said at least one secondary heat exchanger having a heat exchange surface which is maintained, in use, at a temperature such that part of the gaseous effluent condenses to form a liquid coating on said surface, thereby cooling the remainder of the gaseous effluent to a temperature at which at least a portion of the tar, formed during pyrolysis, in said gaseous effluent, condenses, wherein said primary and secondary heat exchangers comprise heat exchange tubes and each heat exchange tube of said secondary heat exchanger has an internal diameter equal to or greater than that of each heat exchange tube of said primary heat exchanger; and (d) means for separating said condensed tar and said gaseous effluent.

2. The apparatus of claim 1, wherein said heat exchange surface is disposed substantially vertically and is maintained at said temperature by indirect heat exchange with a heat transfer medium which flows downwards through said at least one secondary heat exchanger.

3. The apparatus as claimed in claim 1, wherein said at least one secondary transfer line heat exchanger includes an inlet for said gaseous effluent and said inlet is thermally insulated from said heat exchange surface to maintain said inlet at a temperature above that at which tar in said gaseous effluent condenses.

4. Apparatus as claimed in claim 1, wherein said at least one secondary heat exchanger is a tube-in-shell or tube-in-tube heat exchanger.

5. Apparatus as claimed in claim 1 further including a decoking system having an inlet for a decoking medium and an outlet for coke, wherein said primary and secondary heat exchangers can be connected to said decoking system such that said decoking medium passes through said at least one primary heat exchanger and then said at least one secondary heat exchanger before flowing to said outlet.

6. Apparatus as claimed in claim 1, wherein said means (d) for separating said condensed tar and said gaseous effluent is a tar knock-out drum.

7. Apparatus as claimed in claim 1, comprising one or more cracked gas coolers connected to and downstream of the means for separating to further cool said gaseous effluent.

8. Apparatus as claimed in claim 7, comprising a water quench tower connected to and downstream of the one or more cracked gas coolers to condense pyrolysis gasoline and/or water in said effluent from the one or more cracked gas coolers.

9. Apparatus as claimed in claim 7, comprising at least one indirect partial condenser connected to and downstream of the one or more cracked gas coolers to condense pyrolysis gasoline and/or water in said effluent from the one or more cracked gas coolers.

10. Apparatus as claimed in claim 7, comprising a deaerator connected to the one or more cracked gas coolers to heat deaerator feed water by indirect contact with said effluent from the one or more cracked gas coolers.

11. Apparatus as claimed in claim 1, comprising at least one partial condenser connected to and downstream of the means for separating to condense pyrolysis gasoline and/or water in said gaseous effluent from the means for separating.

12. Apparatus as claimed in claim 1, comprising a quench water settling drum connected to and downstream of the at least one partial condenser to separate said effluent from the at least one partial condenser into a hydrocarbon fraction and an aqueous fraction.

13. Apparatus as claimed in claim 1, wherein said heat exchange tube of said at least one secondary heat exchanger have one or more fins on the outside surface of said heat exchanger tube.

* * * * *